US006821358B2

(12) United States Patent
Havette et al.

(10) Patent No.: US 6,821,358 B2
(45) Date of Patent: Nov. 23, 2004

(54) FERRITIC STAINLESS STEEL WHICH CAN BE USED FOR FERROMAGNETIC PARTS

(75) Inventors: Etienne Havette, Mercury (FR); Christophe Bourgin, Albertville (FR); Benoît Pollet, Ugine (FR); Jean Lamontanara, Moncalieri (IT)

(73) Assignee: Ugine-Savoie Imphy, Ugine (FR)

( * ) Notice: Subject to any disclaimer, the term of this patent is extended or adjusted under 35 U.S.C. 154(b) by 56 days.

(21) Appl. No.: 10/092,448

(22) Filed: Mar. 8, 2002

(65) Prior Publication Data

US 2002/0129873 A1 Sep. 19, 2002

Related U.S. Application Data

(63) Continuation-in-part of application No. PCT/FR01/02214, filed on Jul. 10, 2001.

(30) Foreign Application Priority Data

Jul. 12, 2000 (FR) ..... 00 09152

(51) Int. Cl.[7] ..... H01F 1/147
(52) U.S. Cl. ..... 148/111; 148/325
(58) Field of Search ..... 148/111, 325; 420/41, 61, 67, 68

(56) References Cited

U.S. PATENT DOCUMENTS 5,427,635 A * 6/1995 Bletton et al. ..... 148/325
5,496,515 A * 3/1996 Pedarre et al. ..... 420/41
5,769,974 A * 6/1998 Masteller et al. ..... 148/651
5,795,411 A * 8/1998 Terrien et al. ..... 148/325

FOREIGN PATENT DOCUMENTS

EP 0 765 941 A1 4/1997
EP 0 774 520 A1 5/1997
EP 0 924 313 A1 6/1999
EP 0 930 375 A1 7/1999
EP 0 999 289 A1 5/2000
JP 55-138057 * 10/1980 ..... 420/36

OTHER PUBLICATIONS

Metals Handbook, 10th Edition, vol. 1, 1990, p. 842.*
Patent Abstracts of Japan, vol. 1999, No. 11, Sep. 30, 1999 & JP 11 172369 A, Jun. 29, 1999.
Patent Abstracts of Japan, vol. 018, No. 468, Aug. 31, 1994 & JP 06 145908 A, May 27, 1994.

* cited by examiner

*Primary Examiner*—John P. Sheehan
(74) *Attorney, Agent, or Firm*—Sughrue Mion, PLLC

(57) ABSTRACT

Ferritic stainless steel, comprising the following composition by weight:

0%<C≦0.030%
1%≦Si≦3%
0%<Mn≦0.5%
10%≦Cr≦13%
0%<Ni≦0.5%
0%<Mo≦3%
N≦0.030%
Cu≦0.5%
Ti≦0.5%
Nb≦1%
Ca≧1×10⁻4%
0≧10×10⁻4%
S≦0.030%
P≦0.030% the remainder being iron and the impurities which are inevitable from the production of the steel.

2 Claims, 1 Drawing Sheet

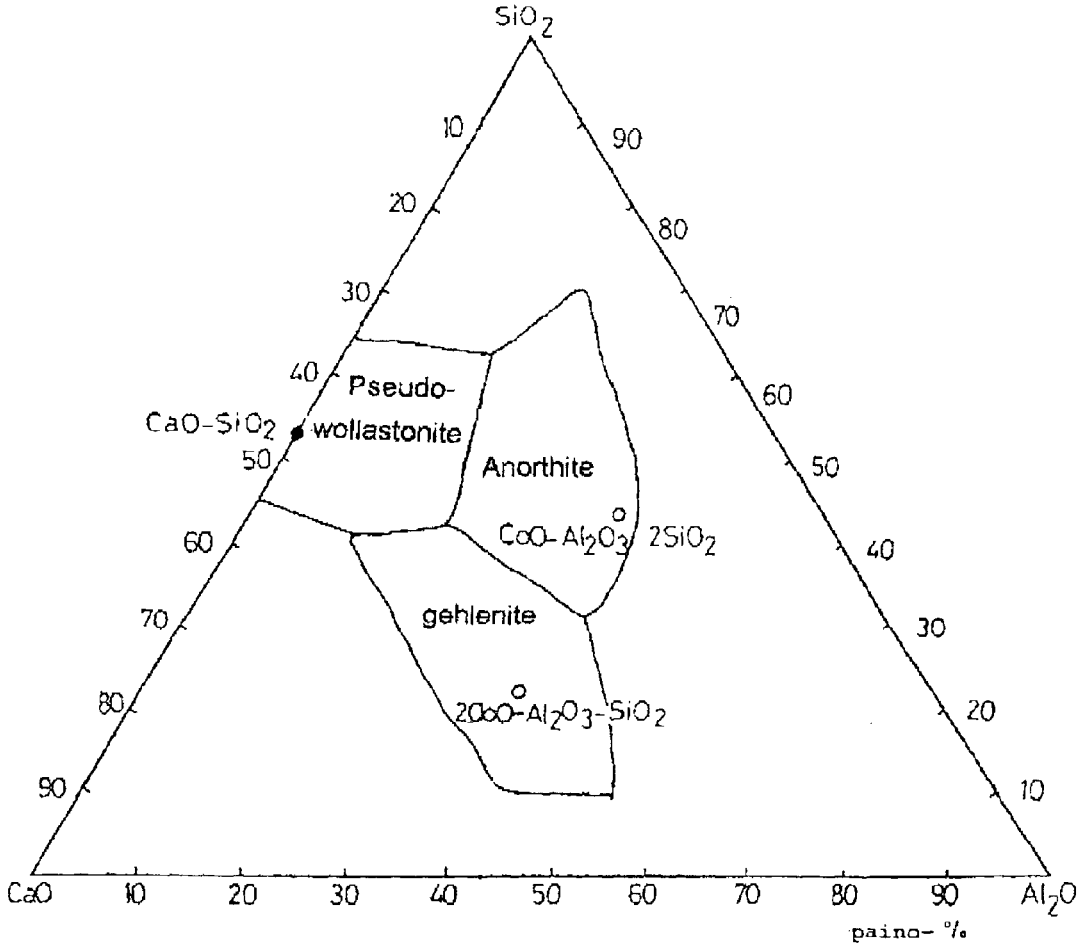
SiO2
CaO
Al2O
paino- %
CaO-SiO2
Pseudo-
wollastonite
Anorthite
CaO-Al2O3-2SiO2
gehlenite
2CaO-Al2O3-SiO2
10
20
30
40
50
60
70
80
90

FERRITIC STAINLESS STEEL WHICH CAN BE USED FOR FERROMAGNETIC PARTS

This is a Continuation-in-Part of PCT/FR01/02214, filed Jul. 10, 2001; the disclosure of which is incorporated herein by reference.

BACKGROUND OF THE INVENTION

The present invention concerns a ferritic stainless steel which can be used for ferromagnetic parts.

Ferritic stainless steels are characterised by a given composition, the ferritic structure being notably provided, after hot rolling and cooling of the composition, by a thermal annealing treatment conferring the said structure on them.

Amongst the major classes of ferritic stainless steels, defined notably according to their chromium and carbon content, there are:

- the ferritic stainless steels which can contain up to 0.17% carbon. These steels, after the cooling which follows their production, have a two-phase austeno-ferritic structure. They may however be converted into ferritic stainless steels after annealing in spite of a relatively high carbon content;
- the ferritic stainless steels whose chromium content is around 11 or 12%. They are fairly close to martensitic steels containing 12% chromium, but different through their carbon content, which is relatively low.

During the hot rolling of stainless steels, the structure of the steel can be two phase, ferritic and austenitic. If the cooling is, for example, energetic, the final structure is ferritic and martensitic. If it is slower, the austenite decomposes partially into ferrite and carbides, but with a higher carbide content than the surrounding matrix, the austenite having solubilised hot more carbon than ferrite. In both cases, a tempering or annealing must be performed on the hot-rolled and cooled steels in order to generate a completely ferritic structure. The tempering can be carried out at a temperature of approximately 820° C. lower than the Ac1 alpha→ gamma transition temperature, which gives rise to a precipitation of carbides.

In the field of ferritic steels intended for an application using magnetic properties, the ferritic structure is obtained by limiting the quantity of carbides, and it is for this reason that the ferritic stainless steels developed in this field have a carbon content below 0.02%.

DESCRIPTION OF THE PRIOR ART

Steels are known which can be used for their magnetic properties, such as for example in the document U.S. Pat. No. 5, 769,974, which describes a method of manufacturing a corrosion-resistant ferritic steel able to reduce the value of the coercive field of the said steel. The steel used in the method is a steel of the resulfurated type. The sulfur reduces the cold deformation properties. The steel obtained by the method is therefore difficult to use for the production of cold-forged parts.

The patent U.S. Pat. No. 5,091,024 is also known, in which there are presented corrosion-resistant magnetic articles formed by an alloy consisting essentially of a composition with a low carbon content and a low silicon content, that is to say respectively below 0.03% and 0.5%. However, in the magnetic domain, it is important for the steel to contain a high silicon content in order to increase the resistivity of the material and to reduce eddy currents.

The purpose of the present invention is to present a stainless steel with a ferritic structure which can be used for magnetic parts with strong magnetic properties and presenting good properties of use in terms of cold forging and good machinability properties.

SUMMARY OF THE INVENTION

The object of the invention is a ferritic stainless steel which can be used for ferromagnetic parts which comprises, in its composition by weight:

$0\% < C \leqq 0.030\%$
$1\% \leqq Si \leqq 3\%$
$0\% < Mn \leqq 0.5\%$
$10\% \leqq Cr \leqq 13\%$
$0\% < Ni \leqq 0.5\%$
$0\% < Mo \leqq 3\%$
$N \leqq 0.030\%$
$Cu \leqq 0.5\%$
$Ti \leqq 0.5\%$
$Nb \leqq 1\%$
$Ca \geqq 1\times10^{-4}\%$
$0 \leqq 10\times10^{-4}\%$
$S \leqq 0.030\%$
$P \leqq 0.030\%$ the remainder being iron and the impurities inevitable from the production of the steel.

The other characteristics of the invention are:

- the composition by weight also includes calcium and oxygen so that:
  $Ca > 30\times10^{-4}\%$
  $O > 70\times10^{-4}\%$
- the ratio between the calcium and oxygen content Ca/O being
  $0.2 \leqq Ca/O \leqq 0.6$
- the steel contains inclusions of lime silico-aluminate of the anorthite and/or pseudo-wollastonite and/or gehienite type;
- preferably the steel comprises, in its composition by weight:
  $0\% < C \leqq 0.015\%$
  $1\% \leqq Si \leqq 3\%$
  $0 \leqq Mn \leqq 0.4\%$
  10%Cr 13%
  $0\% < N \leqq 0.2\%$
  $0.2\% \leqq Mo \leqq 2\%$
  $N \leqq 0.015\%$
  $Cu \leqq 0.2\%$
  $Ti \leqq 0.2\%$
  $Nb \leqq 1\%$
  $Ca \leqq 30\times10^{-4}\%$
  $O \leqq 70\times10^{-4}\%$
  $S \leqq 0.003\%$
  $P \leqq 0.030\%$ the remainder being iron and the impurities inevitable from the production of the steel;

- preferably the steel comprises, in its composition by weight:
  $0\% < C \leqq 0.015\%$
  $1\% \leqq Si \leqq 3\%$
  $0 \leqq Mn \leqq 0.4\%$
  $10\% \leqq Cr \leqq 13\%$
  $0\% < Ni \leqq 0.2\%$
  $0.2\% \leqq Mo \leqq 2\%$
  $N \leqq 0.015\%$
  $Cu \leqq 0.2\%$ $Ti \leqq 0.2\%$
$Nb \leqq 1\%$
$Ca \geqq 30 \times 10^{-4}\%$
$O \geqq 70 \times 10^{-4}\%$
$0.015 \leqq S \leqq 0.03\%$
$P \leqq 0.030\%$ the remainder being iron and the impurities inevitable from the production of the steel.

The invention also concerns a method of producing a ferritic steel wherein the composition by weight is subjected, after hot rolling and cooling, to a thermal annealing treatment and then a modification of cross-section of the drawing or stretch forming type.

The drawn or stretch-formed steel can subsequently be subjected to an additional recrystallisation annealing in order to perfect the magnetic properties of the part.

DESCRIPTION OF THE PREFERRED EMBODIMENTS

The following description and the single figure, the whole given by way of non-limitative example, will give a clear understanding of the invention.

The single figure presents a ternary diagram giving the general composition of the inclusions of aluminosilicates of lime.

The invention concerns a steel with the following general composition:

$0\% < C \leqq 0.030\%$
$1\% \leqq Si \leqq 3\%$
$0\% < Mn \leqq 0.5\%$
$10\% \leqq Cr \leqq 13\%$
$0\% < Ni \leqq 0.5\%$
$0\% < Mo \leqq 3\%$
$N \leqq 0.030\%$
$Cu \leqq 0.5\%$
$Ti \leqq 0.5\%$
$Nb \leqq 1\%$
$Ca \geqq 1 \times 10^{-4}\%$
$O \geqq 10 \times 10^{-4}\%$
$S \leqq 0.030\%$
$P \leqq 0.030\%$ the remainder being iron and the impurities inevitable from the production of the steel.

From the metallurgical point of view, certain elements contained in the composition of a steel promote the appearance of the ferritic phase with body-centred cubic structure. These elements are known as alphagenes. Amongst these appear notably chromium and molybdenum. Other elements known as gammagenes promote the appearance of the gamma-austenitic phase with a face-centred structure. Amongst these elements are nickel as well as carbon and nitrogen. It is therefore necessary to reduce the proportion of these elements and it is for these reasons that the steel according to the invention has in its composition less than 0.030% carbon, less than 0.5% nickel and less than 0.030% nitrogen.

Carbon is harmful with respect to forging, corrosion and machinability. In general terms, in the field of magnetic properties, the precipitates must be reduced since they constitute obstacles to the movements of Bloch walls.

Concerning the other elements in the composition, the nickel, manganese and copper in the composition, due to the industrial production of steel, are merely residual elements which it is sought to reduce and even to eliminate.

Titanium and/or niobium form compounds including titanium and/or niobium carbide, which prevents the formation of chromium carbides and nitrides. They thereby promote corrosion resistance and notably the corrosion resistance of welds.

Sulfur is limited so as to optimise the behaviour of the steel in the field of cold forging and to optimise the magnetic properties.

Silicon is necessary for increasing the resistivity of the steel in order to reduce eddy currents, and is favourable to corrosion resistance.

Steels according to the invention can also contain 0.2% to 3% molybdenum, an element improving corrosion resistance and promoting the formation of ferrite.

In the field of their use, ferritic stainless steels pose problems of machinability.

This is because a major drawback of ferritic steels is the poor conformation of the swarf. They produce long tangled swarf, which is very difficult to fragment. This drawback may become very detrimental in machining methods where the swarf is confined, such as for example in deep drilling or sawing.

One solution afforded in order to mitigate the problems of machining ferritic steels is to introduce sulfur into their composition or elements of the lead, tellurium or selenium type which impair either the mechanical properties of cold deformation or corrosion resistance, or the magnetic properties. The said ferritic steels normally contain hard inclusions of the chromite type (Cr Mn, Al Ti)O, alumina (AlMg)O, silicate (SiMn)O, abrasives for cutting tools.

According to the invention, the ferritic stainless steel can also contain in its composition by weight more than $30 \times 10^{-4}\%$ calcium and more than $70 \times 10^{-4}\%$ oxygen.

The introduction of calcium and oxygen in a controlled and intentional fashion satisfying the relationship $0.2 \leqq Ca/O \leqq 0.6$ promotes, in the ferritic steel, the formation of malleable oxides of the silicoaluminate of lime type as presented in FIG. 1, which is an $Al_2O_3$; $SiO_2$; CaO ternary diagram, the malleable oxides being chosen in the area of the anorthite, gehlenite and pseudo-wollastonite triple point.

The presence of calcium and oxygen consequently reduces the formation of hard and abrasive inclusions of the chromite, alumina and silicate type. On the other hand, the formation of inclusions of silicoaluminates of lime promotes the breaking up of the swarf and improves the service life of the cutting tools.

It has been found that the introduction of oxides based on calcium into a steel with a ferritic structure, in replacement for the existing hard oxides, only very slightly modifies the other characteristics of the ferritic steel in the field of hot deformation, cold forging, corrosion resistance and magnetic properties.

It has turned out that a steel with a ferritic structure according to the invention, containing no or very little sulfur, has a machining ensuring its industrial use in bar turning, whilst presenting increased corrosion resistance.

The presence of so-called malleable oxides in a ferritic steel gives rise to advantages in the field of drawing and stretch forming.

This is because malleable oxides are able to deform in the direction of rolling, whilst the hard oxides which they replace remain in the form of grains.

In the field of drawing of small-diameter ferritic steel wires, the inclusions chosen according to the invention consequently reduce the rate of breaking of the drawn wire.

In another field of application, for example in polishing operations, the hard inclusions are encrusted in the ferritic steel and cause furrows on the surface.

The ferritic steel according to the invention, having malleable inclusions, can be polished with much greater ease in order to obtain an improved polished surface state.

The steel is produced by electric fusion and then cast continuously in order to form blooms.

The blooms are then subjected to hot rolling for forming for example machine wire or bars.

Annealing is necessary to provide the cold conversion operations on the product, for example drawing and stretch forming.

The steel is subjected to an additional recrystallisation annealing in order to restore and perfect the magnetic properties.

A surface treatment then follows.

In one example application, two steels according to the invention were produced, referenced steel 1 and steel 2, as well as two steels of reference A and B, whose compositions are shown in the following Table 1:

TABLE 1

| % | C | Cr | Si | Mo | Mn | P | N | S | Ni | Cu | Ti | Nb | Ca | C |
|---|---|---|---|---|---|---|---|---|---|---|---|---|---|---|
| Steel 1 | 0.010 | 12.2 | 1.58 | 0.48 | 0.25 | 0.011 | 0.009 | 0.001 | 0.135 | 0.04 | 0.002 | 0.002 | 0.0048 | 0.009 |
| Steel 2 | 0.011 | 11.9 | 1.47 | 0.49 | 0.22 | 0.015 | 0.007 | 0.029 | 0.126 | 0.06 | 0.003 | 0.002 | 0.0062 | 0.012 |
| Ref A | 0.015 | 17.4 | 1.25 | 0.35 | 0.5 | 0.02 | 0.02 | 0.28 | 0.3 | 0.1 | 0.003 | 0.002 | 0.002 | 0.006 |
| Ref B | 0.016 | 17.5 | 1.37 | 1.53 | 0.38 | 0.018 | 0.017 | 0.277 | 0.29 | 0.06 | 0.003 | 0.003 | 0.0017 | 0.007 |

These steels have been converted into 10 mm diameter bars according to the following method:

hot rolling of a 11 mm round, annealing, drawing to a diameter of 10 mm, final annealing, dressing and planing, then they were characterised for magnetic properties, machinability, cold forging and corrosion.

The steels according to the invention have better magnetic characteristics than the reference steels, as presented in Table 2 below.

TABLE 2

| Steel | Hc(A/m) coercive field |
|---|---|
| Steel 1 | 109 |
| Steel 2 | 115 |
| Ref A | 184 |
| Ref B | 177 |

These characteristics are due to a low proportion of addition elements, in particular a chromium content of approximately 12%.

Steel 2 behaves very well in the field of machining by bar turning, in spite of a limited sulfur content. This is explained by the presence of calcium and oxygen.

Steel 1 has very good suitability for cold forging, because of its low sulfur content. On parts previously forged, the finishing machining by bar turning is effected correctly, without any particular problem.

Steels 1 and 2 behave very well in the field of corrosion, despite their low chromium content, as can be seen in Table 3 below. This is due, with steel 1, to a low sulfur content and, with steel 2, to a limited sulfur content combined with a low manganese content.

TABLE 3

| | Potential for corrosion pitting in NaCl 0.02 M at 23° C. | Corrosion in $H_2SO_4$ 2 M at 23° C. |
|---|---|---|
| Steel 1 | 220 mV/ECS | 10 mA/cm$^2$ |
| Steel 2 | 215 mV/ECS | 11 mA/cm$^2$ |
| Ref A | 205 mV/ECS | 24 mA/cm$^2$ |
| Ref B | 330 mV/ECS | 6 mA/cm$^2$ |

The steel according to the invention can be used particularly for the manufacture of ferromagnetic parts such as, for example, solenoid valve parts, injectors for direct petrol injection systems, central door locking in the automobile field and any application requiring parts of the magnetic core or inductor type. In the form of a leaf, they can be used in current transformers or magnetic shielding.

What is claimed is:

1. A method of producing a ferritic stainless steel which can be used for ferromagnetic parts, wherein the steel comprises, in its composition by weight:

$0\% < C \leqq 0.030\%$ $1\% \leqq Si \leqq 3\%$ $0\% < Mn \geqq 0.5\%$ $10\% \leqq Cr \leqq 13\%$ $0\% < Ni \leqq 0.5\%$ $0\% < Mo \leqq 3\%$ $N \leqq 0.030\%$ $Cu \leqq 0.5\%$ $Ti \leqq 0.5\%$ $Nb \leqq 1\%$ $Ca \geqq 1\times10^{-4}\%$ $0 \geqq 10\times10^{-4}\%$ $S \leqq 0.030\%$ $P \leqq 0.030\%$ the remainder being iron and the impurities which are inevitable from the production of the steel; the method comprising subjecting the steel, after hot rolling and cooling, to an annealing heat treatment and then to a modification of cross-section by the method taken from the group of drawing and stretch forming.

2. The method according to claim 1, wherein the steel is subsequently subjected to an additional recrystallisation annealing in order to perfect the mechanical properties of the parts.

* * * * *